US006244781B1

(12) United States Patent
Roller

(10) Patent No.: US 6,244,781 B1
(45) **Date of Patent: *Jun. 12, 2001**

(54) APPARATUS FOR PROTECTING STRUCTURAL SUPPORTS

(75) Inventor: Joseph A. Roller, Ashtabula, OH (US)

(73) Assignee: Hero Products, Inc., Ashtabula, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/538,159

(22) Filed: Mar. 29, 2000

Related U.S. Application Data

(63) Continuation of application No. 09/132,913, filed on Aug. 12, 1998.

(60) Provisional application No. 60/055,276, filed on Aug. 13, 1997.

(51) Int. Cl.[7] ..... E02D 5/60

(52) U.S. Cl. ..... 404/6; 52/736.4; 267/116; 405/216

(58) Field of Search ..... 404/6; 405/212, 405/215, 216; 52/736.3, 736.4; 428/36.9; 267/139, 116, 113

(56) References Cited

U.S. PATENT DOCUMENTS

| | | |
|---|---|---|
| 3,126,035 | 3/1964 | Espetvedt . |
| 3,181,849 | 5/1965 | Mitchell . |
| 3,831,941 | 8/1974 | Pease . |
| 3,939,665 | 2/1976 | Gosse et al. . |
| 3,997,150 | 12/1976 | Hanson et al. . |
| 4,058,985 | 11/1977 | Liddell . |
| 4,072,022 | 2/1978 | Shimizu . |
| 4,113,110 | 9/1978 | Mittag . |
| 4,244,156 | 1/1981 | Watts, Jr. . |
| 4,709,833 | 12/1987 | Granberg et al. . |
| 4,764,054 | 8/1988 | Sutton . |
| 4,877,224 | 10/1989 | Watts . |
| 4,880,088 | 11/1989 | De Oliveira . |
| 4,901,472 | 2/1990 | Donohue et al. . |

(List continued on next page.)

FOREIGN PATENT DOCUMENTS

| | | |
|---|---|---|
| 3039897 A1 | 5/1982 | (DE) . |
| 3505097 A1 | 8/1986 | (DE) . |
| 94 18 180 | 11/1994 | (DE) . |
| 0360761 A1 | 3/1990 | (EP) . |
| 0780518 A1 | 6/1997 | (EP) . |

OTHER PUBLICATIONS

Advertisements for the Column Cushion described in Applicant's Background of the Invention, including three sheets of photocopies and one original color p. 45, IEN/Aug. '99.

*Primary Examiner*—Robert E. Pezzuto
*Assistant Examiner*—Alexander K. Pechhold
(74) *Attorney, Agent, or Firm*—Jones, Day, Reavis & Pogue

(57) ABSTRACT

An apparatus for protecting structural supports from damage when impacted by an object such as a moving vehicle is provided. The apparatus has a shaped component which in the preferred embodiment is a semi-cylindrical component having a body defined by a wall, a top, and a base. The wall has at least one flat wall face and surrounds a hollow interior. An indentation for receiving a structural support is present in at least one flat wall face. A device for securing the shaped component to the structural support and for firmly seating one component at its flat wall face against the second component at its flat wall face when two components are present. Preferably, each component has a plurality of impact absorbing indentations, each having an aperture, a base and a wall extending from the base to an aperture mouth. These indentations function to re-distribute the energy of impact when a collusion occurs between the apparatus and a moving object. Preferably, each component is formed by rotational molding from a plastic resin.

25 Claims, 4 Drawing Sheets

U.S. PATENT DOCUMENTS

| | | |
|---|---|---|
| 5,002,423 | 3/1991 | Mileti . |
| 5,006,386 | 4/1991 | Menichini . |
| 5,048,229 | 9/1991 | Campbell . |
| 5,059,109 | 10/1991 | Dickhut et al. . |
| 5,331,696 | 7/1994 | Armstrong et al. . |
| 5,369,925 | 12/1994 | Vargo . |
| 5,429,449 | 7/1995 | Baatz . |
| 5,439,035 | 8/1995 | Dal Paluù Attilio . |
| 5,447,765 | 9/1995 | Crane . |
| 5,487,618 | 1/1996 | Cox . |
| 5,562,364 | 10/1996 | Darder-Alomar . |

APPARATUS FOR PROTECTING STRUCTURAL SUPPORTS

This application is a continuation of Ser. No. 09/132,913 filed Aug. 12, 1998, which claims benefit of Provisional No. 60/055,276 filed Aug. 13, 1997.

FIELD OF THE INVENTION

An apparatus for protecting structural columns and supports from damage resulting from impact from a moving vehicle while preventing or reducing damage to that vehicle and its driver is provided. The inventive apparatus finds use in aquatic and in industrial settings such as in a warehouse where loaders and tow motors impact structural supports or at a wharf where small boats are docking. The apparatus also finds use as a safety device to reduce and prevent damage to vehicles and their drivers during collisions with stationary objects such as poles, posts, and the like.

BACKGROUND OF THE INVENTION

Accidental collisions between vehicles such as cars, trucks and boats and support structures such as poles or columns occur frequently. When vehicles are backing, limited visibility adds to the problem of safely avoiding the structural supports. If the area is crowded with other vehicles or with materials to be moved such as in a warehouse, backing of a vehicle can be especially problematic. Accidental acceleration or poor traction due to spills or wet surfaces often also results in collisions between vehicles and structural supports such as light poles, telephone poles, traffic lights, and the like. Accidental acceleration or poor judgement of the distance between a boat and a supporting structure also occur resulting in damage.

In warehouses, previous attempts to protect a structural support or a vehicle and its driver from damage suffered due to collision have tended to protect one or the other, but not both. Further, such devices have been complicated or messy to install or both. Devices which partially enclose a structural support are known. One device to protect people who collide with I-beams from the impact, is the Soft-Post™ Urethane Pad. Such a pad is substantially C-shaped and clips around the upper and lower extensions of the I beam while failing to cover the body of the I. Partial enclosure of a structural support is shown, for example, in U.S. Pat. No. 5,369,925 (Vargo), the disclosure of which is incorporated herein by reference, a three quarters surround post protector which is bolted to the floor. Devices which surround a support thereby providing a greater protection and re-enforcement to the support are known. For example, to protect structural supports, especially those in warehouses, the structural supports have been encased in concrete or such supports have been provided by a hollow cylindrical device filled with concrete or gravel such as the Column Cushion available from Ancon Building Services Div. Goshen, Ind. 46526. Another example of protective apparatus, the pieces of which are connected by a tongue and groove system, is shown in U.S. Pat. No. 5,006,386 (Menichini), the disclosure of which is incorporated herein by reference.

Protective devices also are known and used in aquatic environments such as at the base of a bridge support, on the supporting structures of an oil rig in the ocean and on the posts supporting a wharf. Such devices include encasing the supporting structure in concrete as above and providing a cushioning fender such as in U.S. Pat. No. 5,562,364 (Darder-Alomar), the disclosure of which is incorporated herein by reference.

None of the aforementioned provides the combined properties of impact absorption, protection of the structural support, cost effectiveness in manufacturing, and ease of installation which are provided by the inventive apparatus.

It is an object of this invention to provide a protective apparatus which is resilient and absorbs and redistributes impact.

It is another object of the instant invention to provide a protective apparatus which is easy to install and economical to manufacture.

SUMMARY OF THE INVENTION

An apparatus for protecting a structural support and absorbing impact is provided. The apparatus for protecting a structural support includes a shaped component for receiving a structural support and a means for securing the shaped component to the structural support. In the preferred embodiment, the apparatus is comprised of two shaped components which are mirror images of one another and a means to secure one component to the other component. Most preferably, each is a semi-cylindrical component having a top, a base, and a wall. Each top, base and wall has an exterior face, an interior face. A hollow interior is defined by the wall, top and base, thus providing a body. Each semi-cylindrical component has a flat exterior face and a rounded exterior face. An indentation for receiving a supporting structure is present at the flat exterior face and extends from the top to the base. Preferably, indentations for absorbing impact are present at the rounded exterior face.

The body wall of each semi-cylindrical component has a thickness and is comprised of a plastic material which may be a vinyl, a polyethylene, a polypropylene, or a polyurethane. Preferably, the body is comprised of a UV stabilized polyethylene which is shaped by rotational molding. Each semi-cylindrical component is highly resilient, stress crack resistant, a semi-flexible. Preferably, each body of the two semi-cylindrical components has a vent hole. Advantageously, due to the flexibility of the body material, the semi-cylindrical components conform to the shape of the structural support at their respective flat faces when the two semi-cylindrical components are placed face to face and are stabilized in position by the means for securing the shaped component to the structural support, thus slippage around the support is minimized.

In the preferred embodiment, at the exterior rounded face of each of the semi-cylindrical components, are a plurality of discontinuous indentations for absorbing impact. Each has an aperture mouth, an aperture base and a plurality of aperture walls extending from the aperture base to the aperture mouth. The aperture walls and aperture base are continuous with the wall of the semi-cylindrical body. The discontinuous indentations function to deflected impact energy away from the structural support. The discontinuous indentations at their respective aperture bases terminate in the hollow body interior at a distance from the interior flat face of the wall. Thus, a hollow region remains between the aperture base and the interior surface of the flat wall face to protect, cushion and redistribute the energy of the impact traveling towards the structural support. Preferably, the aperture walls form an angle at their respective aperture bases. Most preferably, each aperture base has a smaller area than that of the aperture mouth.

Also present at the exterior face of the rounded wall of the body is a continuous indentation for receiving a means for securing the shaped components to the structural support. The continuous indentation is seated at approximately the same position on each of the two semi-cylindrical components so that when the means for securing the shaped components to the structural supports secured at a circumference, the semi-cylindrical components are positioned on the structural support. Preferably, the means for securing the shaped components to the structural support is a belt or a strap having a hooked surface at one end and a napped surface for mating to the hooked surface at the opposite end.

DESCRIPTION OF THE BEST MODE OF THE INVENTION

Figure 1:
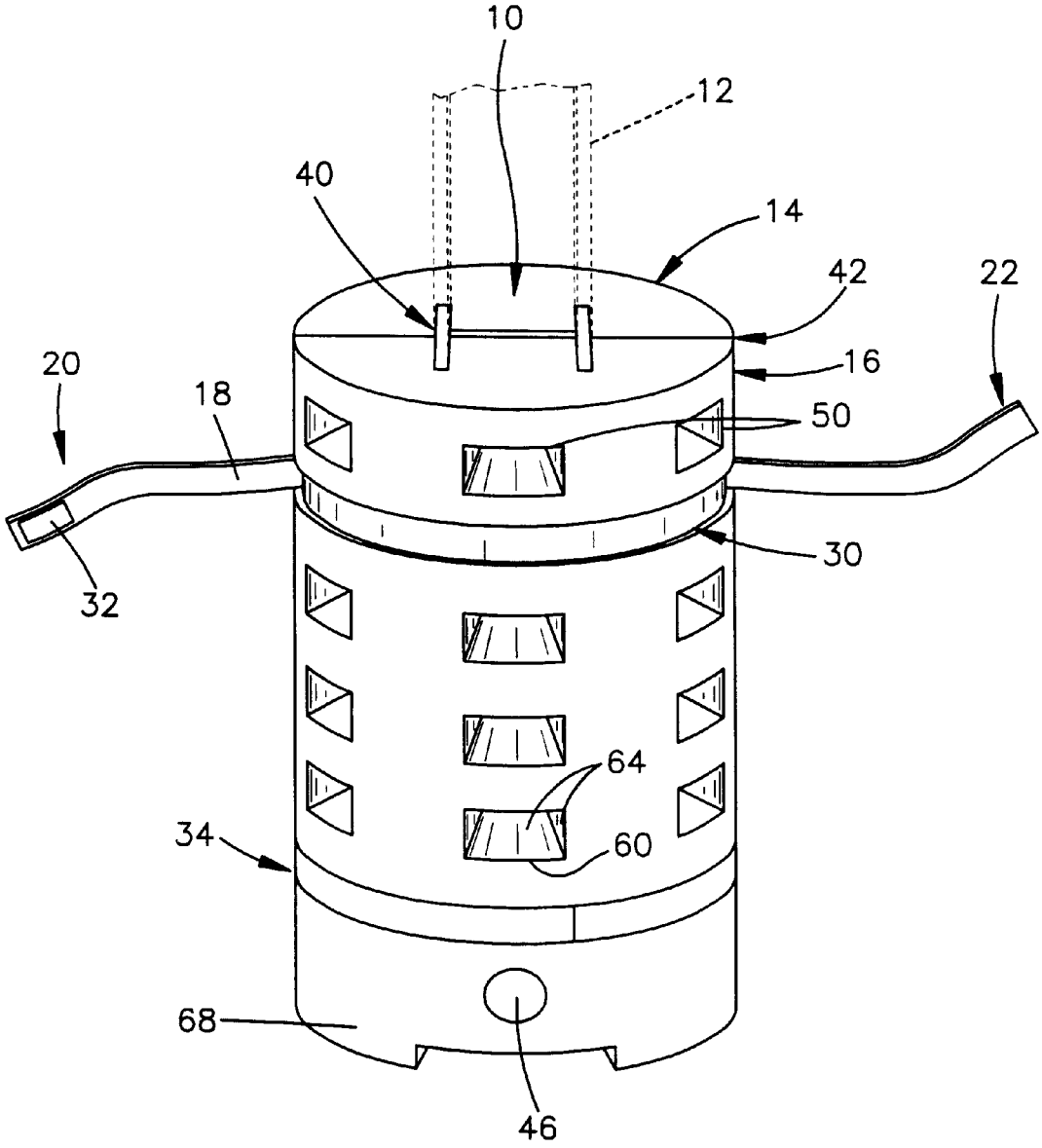
FIG. 1 is a front isometric view of one embodiment of the apparatus having two semi-cylindrical components for protecting a structural support where the apparatus is held in position by a means for securing the shaped components to the structural support.

Referring now to FIG. 1 which illustrates a first embodiment of the inventive apparatus 10 seated about an I beam structural support 12, the apparatus has a first semi-cylindrical component 14 and a second semi-cylindrical component 16 held in place by a means for securing the shaped components 14 and 16 to the structural support. The means for securing the shaped component to the structural support 12 illustrated is a belt or a strap 18 having a first end 20 and a second end 22. In the open position, the first end 20 and the second end 22 extend from either side of the apparatus 10 at an indentation 30 for seating the means for securing the shaped components 14 and 16 to the structural support 12. The first end 20 is shown to have a hooked surface 32 on a first face. The second end 22 has a napped surface on a second face (not shown). When the ends 20 and 22 are mated at the aforementioned faces, the hooked surface 32 engages the napped surface, thereby making a closed loop 34. Tension is applied when mating the hooked and the napped surfaces to secure the two semi-cylindrical components 14 and 16 at their respective exterior flat wall surfaces one to the other in position around the structural support 12 at the indentation 40 for receiving the structural support. The means for securing the shaped components 14 and 16 to the structural support 12 is preferably made of a strong, flexible, material belt such as a nylon fabric and a fastener such as Velcro™. However, other materials such as leather or another type of fabric may be used and other fasteners such as buckles may be used as should be apparent to one skilled in the art.

A seam, generally referenced as 42, is created between the two semi-cylindrical components 14 and 16 when the components 14 and 16 are mated at their respective edges. The seam 42 is closely sealed by the means for securing the shaped components 14 and 16 to the structural support. Preferably, air vents, generally referenced as 46, holes which extend from the interior face through to the exterior face of the rounded wall of the body are present in each semi-cylindrical component 14 and 16. The two vents 46 in the first embodiment have differing locations on the two components 14 and 16, as seen by comparison of FIGS. 1 and 2. The apparatus 10 is preferably comprised of a UV stabilized resilient plastic.

Figure 2:
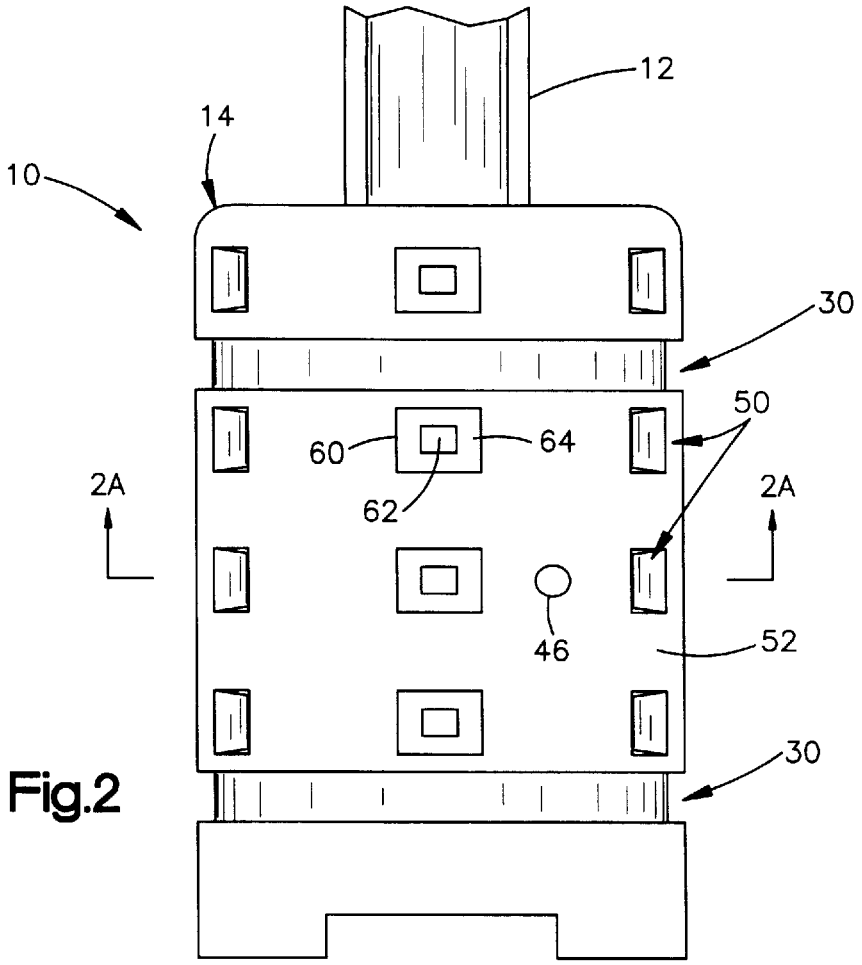
FIG. 2 is a rear view of the apparatus of FIG. 1 with an I beam seated in a central position and indicates the position through which a cross-section is taken.
Figure 2A:
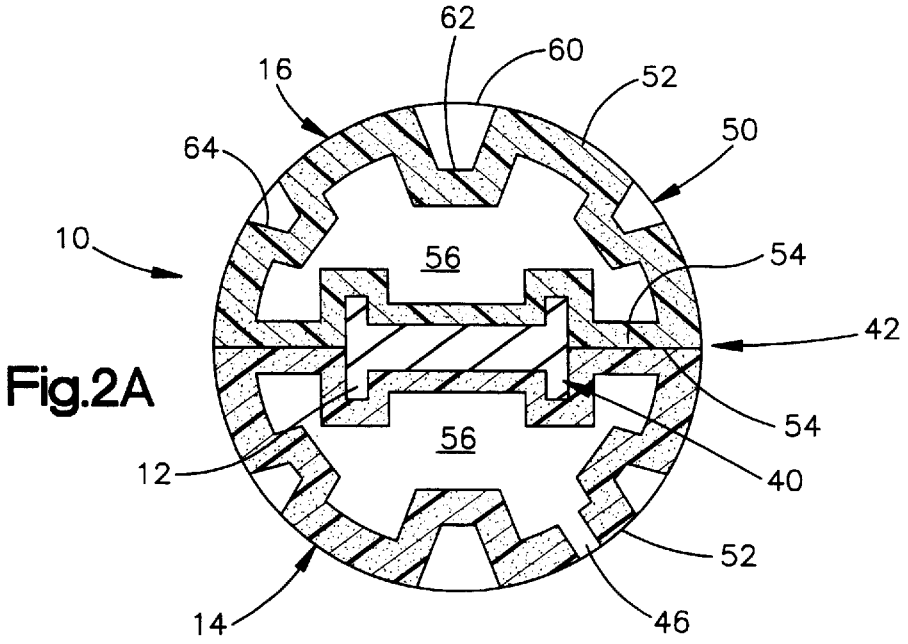
FIG. 2A shows a cross-section of the apparatus of FIG. 2.

Referring now to FIG. 2A which is a cross-section of FIG. 2 in the plane indicated, each semi-cylindrical component 14 and 16 has a plurality of discontinuous indentations, generally referenced by the number 50; a rounded exterior wall face 52; a flat exterior wall face 54; and a hollow interior space 56. Each discontinuous indentation 50 has an aperture mouth 60, an aperture base 62 having a variable width, and a plurality of aperture walls 64 extending from the aperture base 62 to the aperture mouth 60. These discontinuous indentations 50 function to redistribute impact energy when the apparatus 10 is struck. Each air vent 46 functions to vent air from the hollow interior 56 of the respective component 14 or 16 when the apparatus 10 is seated around the structural support 12 and is impacted at the respective component 14 or 16. Conversely, air returns through each air vent 46 to the respective hollow interior 56 after impact when the resilient material regains its former shape. Each semi-cylindrical component 14 and 16 may have a foot 68 at the base or the base may be directly in contact with the floor surface.

Figure 3:
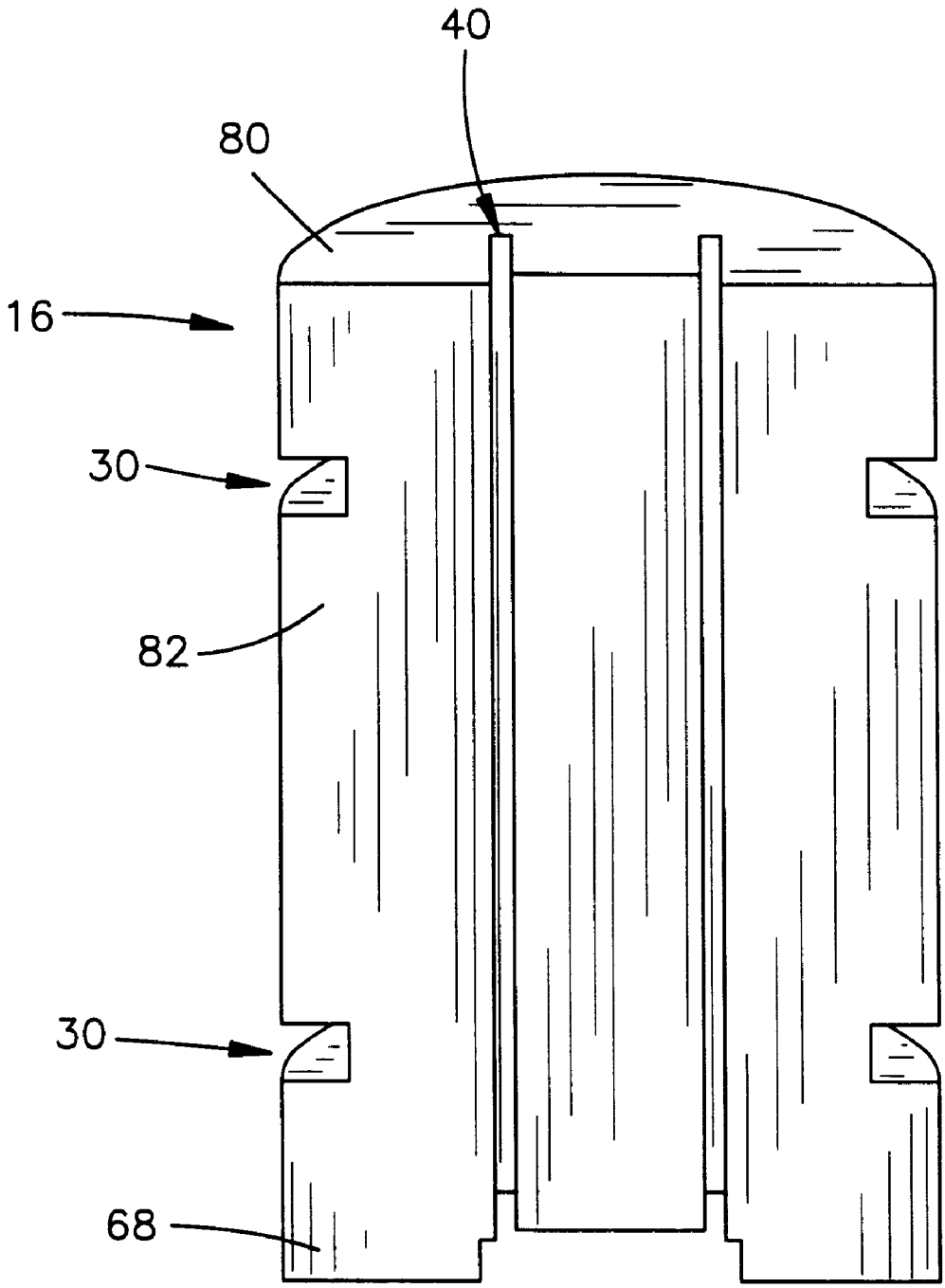
FIG. 3 is a rear isometric view showing the flat wall face of one of the semi-cylindrical components of the apparatus of FIG. 1.

Referring now to FIG. 3, one of the pair of semi-cylindrical components 16 is illustrated in a rear isometric view. The semi-cylindrical component 14 has a top surface 80 and an exterior flat wall face 82 having a substantially flat surface. The flat surface 82 has at its center an indentation 84 defining one half of the indentation 40 (FIG. 1) for receiving the structural support 12. At the rounded exterior face 52 (FIG. 2) of the component 14 the continuous indentations 30, an indentation for receiving a means for securing the shaped component to the structural support 12 extend fully to the flat rear wall surface 82. At the base of the semi-cylindrical component 14 is the optional foot 68.

Figure 4:
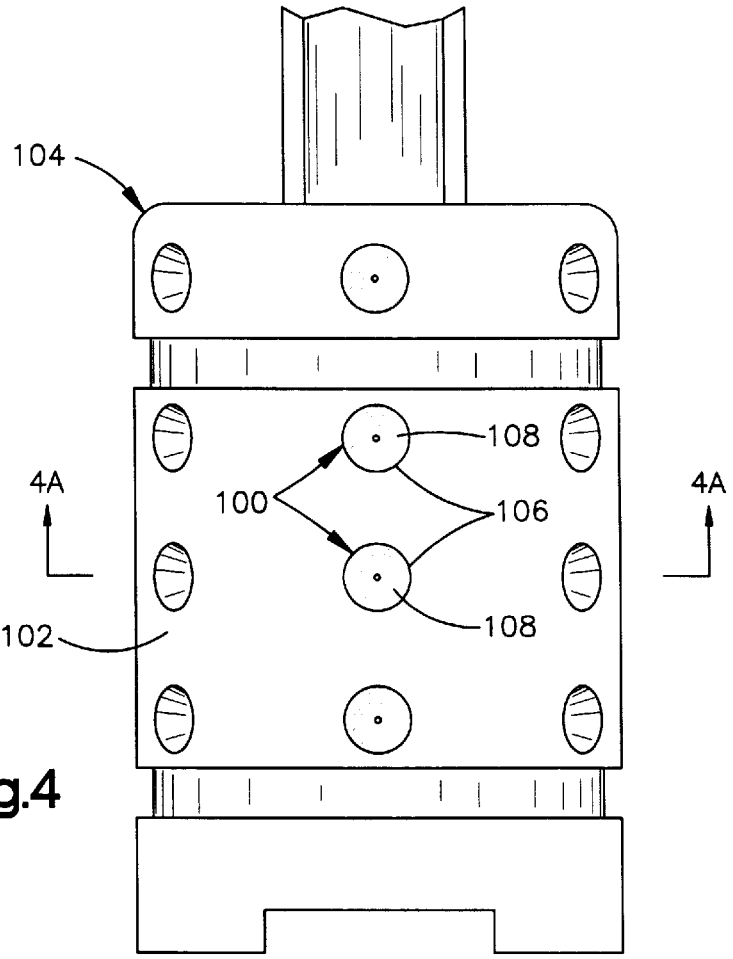
FIG. 4 is a front view of the exterior rounded face of an embodiment of the instant invention wherein the structural support is round in cross-section and indicates the position through which a cross-sectional view is taken.
Figure 4A:
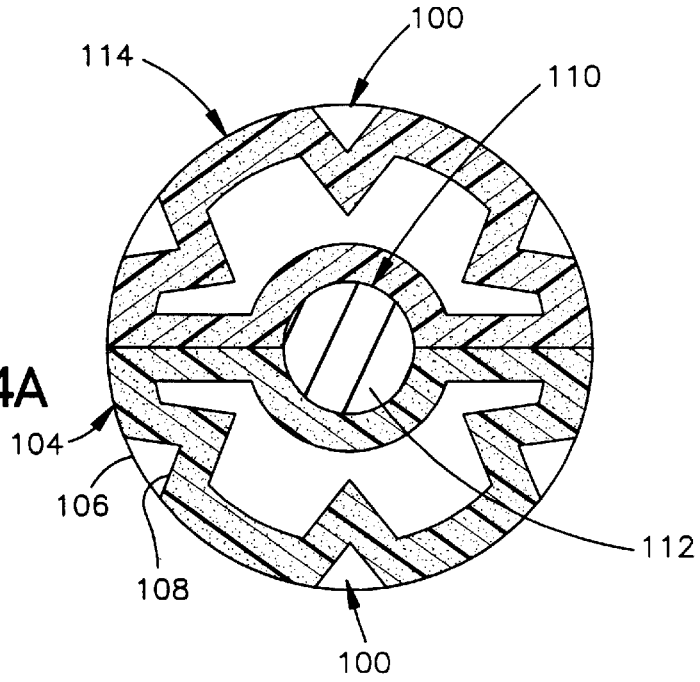
FIG. 4A is a cross-sectional view of the embodiment of FIG. 4.

Referring now to FIG. 4 which illustrates a front view of a second embodiment of the instant invention and which indicates the plane in which the cross-sectional view shown as FIG. 4A is taken, the discontinuous indentations 100 at the rounded exterior face 102 of the semi-cylindrical component 104 have a round shaped aperture 106. As is illustrated in FIG. 4A, the walls 108 of the indentations 100 slant inwardly to provide a cone-shaped indentation 100. The indentation 110 for receiving a structural support 112 is rounded when the components 104 and 114 are juxtaposed one to each other. However, it may also be shaped to receive an I beam or other structural support.

The wall thickness may vary from use to use. Preferably, for use in a warehouse where structural supports are to be protected from impact from tow motors, the wall thickness ranges from about 1 inches to about 3 inches. The base of the discontinuous indentations is distanced from the flat interior wall surface by about 2 inches.

The preferred method of forming the semi-cylindrical components of the instant invention is by rotational molding from a UV stabilized rotational grade molding resin such as for example a polyethylene LLDPE resin, NRA-235 (available from Mobil Polymers, Norwalk, Conn.) which forms a resilient product after molding. As a result of the rotational molding process, the stress crack resistant surface is formed. However, the exterior face of each component may be provided with a coating of a second plastic material. Biocidal agents may be incorporated into the second plastic coating to prevent or retard growth on the apparatus especially in, for example, aquatic environments.

The instant invention may be stacked one apparatus on top of the other to provide greater protection at a height above the first apparatus for protecting a structural support.

While the apparatus has been described as comprised of two semi-cylindrical components, rotational molding also allows for the formation of other shapes, such as triangular, rectangular and so on, depending upon the shape of the structural to be protected and the direction of expected impact. Further, the body itself absorbs impact an does not require discontinuous indentations for low energy impact uses. For example, should the structure be an overhanging one, such as for example a drive through at a restaurant, a body having a top, a base, a wall and a hollow interior may be formed. When the body is mounted at the under-surface of the overhang, impact results in air release from the hollow interior and in impact absorption.

The foregoing is considered only illustrative of the currently preferred embodiments of the invention presented herein. Since numerous modifications and changes will occur to those skilled in the art, it is not desired to limit the invention to the exact construction used to illustrate the various means comprising this invention.

What is claimed is:

1. An apparatus for protecting an elongated structural support from impact said apparatus comprising:

an elongated impact protection component in the form of a single unitary part having a top, a base, and a peripheral side wall, said side wall having a rear portion configured to mate with the structural support so as to seat said component in an installed position adjoining the structural support;

said side wall surrounding an air chamber and further having a front portion configured to deflect inwardly toward said rear portion so as to reduce the volume of said air chamber upon the impact of a vehicle or the like, and thereby to protect the structural support from said impact;

said front portion of said side wall having inner and outer surfaces with undulating contours that define projections at said inner surface and corresponding indentations at said outer surface.

2. An apparatus as defined in claim 1 wherein said component is one of a plurality of elongated impact protection components configured to fit together beside each other in installed positions in which said components define transversely adjacent segments of an elongated impact protection body that surrounds the structural support.

3. An apparatus as defined in claim 2 wherein said components are alike.

4. An apparatus as defined in claim 2 wherein said components are semi-cylindrical.

5. An apparatus as defined in claim 1 wherein said indentations are spaced apart from each other along the length and around the periphery of said front portion of said side wall.

6. An apparatus as defined in claim 5 wherein said indentations have rectangular peripheral shapes.

7. An apparatus as defined in claim 5 wherein said indentations have circular peripheral shapes.

8. An apparatus as defined in claim 1 wherein said component is formed of material that imparts rigidity sufficient for the component normally to stand upright in an original, self-supported hollow configuration defining said air chamber.

9. An apparatus as defined in claim 1 wherein said component has a vent which is open in use of said component and through which air can exhaust air from said air chamber upon said reduction of said volume.

10. An apparatus for protecting an elongated structural support from impact, said apparatus comprising:

a plurality of elongated impact protection components configured to fit together beside each other in installed positions in which said components define transversely adjacent segments of an elongated impact protection body that surrounds the structural support;

each of said components being a single unitary part having a peripheral side wall with a rear portion configured to mate with the structural support upon movement of the component transversely into its installed position;

each of said side walls surrounding a respective air chamber and further having a front portion configured to deflect inwardly toward said rear portion so as to reduce the volume of said respective air chamber upon the impact of a vehicle or the like, and thereby to protect the structural support from said impact.

11. An apparatus as defined in claim 10 wherein each of said components is formed of material that imparts rigidity sufficient for the component normally to stand upright in an original, self-supported hollow configuration defining the respective air chamber.

12. An apparatus as defined in claim 10 wherein said components are a pair of components configured to define transversely opposed halves of said impact protection body.

13. An apparatus as defined in claim 10 wherein said components are alike.

14. An apparatus as defined in claim 10 wherein each of said components has a vent which is open in use of the component and through which air can exhaust air from the respective air chamber upon said reduction of said volume.

15. An apparatus for protecting a structural support from impact, said apparatus comprising:

an impact protection component in the form of a single unitary part having a top, a base, and a peripheral side wall, said side wall having a rear portion configured to mate with the structural support so as to seat said component in an installed position adjoining the structural support;

said side wall surrounding an air chamber and further having a front portion configured to deflect inwardly toward said rear portion so as to reduce the volume of said air chamber upon the impact of a vehicle or the like, and thereby to protect the structural support from said impact;

said component further having an opening which is open in use of said component and through which air can vent from said air chamber upon said reduction of said volume.

16. An apparatus as defined in claim 15 wherein said component is one of a plurality of elongated impact protection components which are unitary parts configured to fit together beside each other in installed positions in which said components define transversely adjacent segments of an elongated impact protection body that surrounds the structural support.

17. An apparatus as defined in claim 16 wherein said components are alike.

18. An apparatus as defined in claim 16 wherein said components are semi-cylindrical.

19. An apparatus as defined in claim 15 wherein said opening is located at said side wall.

20. An apparatus as defined in claim 15 wherein said opening is circular.

21. An apparatus as defined in claim 15 wherein said opening is a solitary opening providing a total flow area through which air can vent from said air chamber upon said reduction of said volume.

22. An apparatus as defined in claim 15 wherein said component is formed of material that imparts rigidity sufficient for the component normally to stand upright in an original, self-supported hollow configuration defining said air chamber.

23. An apparatus for protecting a structural support from impact, said apparatus comprising:

an impact protection component in the form of a single unitary part having a top, a base, and a peripheral side wall, said side wall having a rear portion configured to mate with the structural support so as to seat said component in an installed position adjoining the structural support;

said side wall surrounding an air chamber and further having a front portion configured to deflect inwardly toward said rear portion so as to reduce the volume of said air chamber upon the impact of a vehicle or the like, and thereby to protect the structural support from said impact;

said rear portion of said side wall having flat faces that are located opposite each other so as to mate with corresponding opposite flat faces of the structural support, and being flexible so as to conform to the shape of the structural support at the opposite flat faces of the structural support so as to fit said component closely in said installed position adjoining the structural support;

said component being one of a plurality of elongated impact protection components which are unitary parts configured to fit together beside each other in installed positions in which said components define transversely adjacent segments of an elongated impact protection body that surrounds the structural support.

24. An apparatus as defined in claim 23 wherein said components are alike.

25. An apparatus as defined in claim 23 wherein said components are semi-cylindrical.

* * * * *